US006820431B2

(12) United States Patent
McManus et al.

(10) Patent No.: US 6,820,431 B2
(45) Date of Patent: Nov. 23, 2004

(54) ACOUSTIC IMPEDANCE-MATCHED FUEL NOZZLE DEVICE AND TUNABLE FUEL INJECTION RESONATOR ASSEMBLY

(75) Inventors: Keith McManus, Clifton Park, NY (US); Simon Sanderson, Clifton Park, NY (US); Jeffrey Goldmeer, Latham, NY (US)

(73) Assignee: General Electric Company, Niskayuna, NY (US)

( * ) Notice: Subject to any disclaimer, the term of this patent is extended or adjusted under 35 U.S.C. 154(b) by 70 days.

(21) Appl. No.: 10/284,881

(22) Filed: Oct. 31, 2002

(65) Prior Publication Data

US 2004/0083738 A1 May 6, 2004

(51) Int. Cl.[7] ..... F02C 7/22; F02C 7/24; F23Q 9/08

(52) U.S. Cl. ..... 60/776; 60/725; 60/740; 431/44

(58) Field of Search ..... 60/776, 740, 725, 60/748; 431/44

(56) References Cited

U.S. PATENT DOCUMENTS 5,211,004 A 5/1993 Black
5,791,889 A * 8/1998 Gemmen et al. ..... 431/1
6,272,842 B1 * 8/2001 Dean ..... 60/39.23
6,305,927 B1 * 10/2001 Keller ..... 431/114
6,615,587 B1 * 9/2003 Schulze ..... 60/737

* cited by examiner

*Primary Examiner*—Charles G. Freay
(74) *Attorney, Agent, or Firm*—Patrick K. Patnode; Christian G. Cabou

(57) ABSTRACT

A fuel nozzle device suitable for use in a gas turbine engine or the like is provided. The fuel nozzle device includes a fuel line and a plurality of gas orifices disposed at a downstream end of the fuel line, the plurality of gas orifices operable for injecting fuel into an air stream. The acoustic resistance of each of the plurality of gas orifices is chosen to match the acoustic impedance of the fuel line such that the maximum acoustic energy may be transferred between the fuel nozzle device and the combustor, thus enhancing the ability of the fuel nozzle device to control the combustion dynamics of the gas turbine engine system. A fuel injection resonator assembly suitable for use in a gas turbine engine or the like is also provided. The fuel injection resonator assembly includes a plurality of orifices separated by a variable length tube. The area ratio of the plurality of orifices may be adjusted using an automated valve system or the like to modify and/or control the relative flow resistance of the plurality of orifices. The resulting fuel injection resonator assembly acts as a tunable acoustic waveguide operable for delivering fuel to the combustor.

44 Claims, 9 Drawing Sheets

Prior Art

ACOUSTIC IMPEDANCE-MATCHED FUEL NOZZLE DEVICE AND TUNABLE FUEL INJECTION RESONATOR ASSEMBLY

FIELD OF THE INVENTION

The present invention relates generally to the field of combustion dynamics. More specifically, the present invention relates to an acoustic impedance-matched fuel nozzle device, a tunable fuel injection resonator assembly, and associated methods suitable for use in conjunction with a gas turbine engine or the like.

BACKGROUND OF THE INVENTION

It is known to those of ordinary skill in the art that relatively low-pressure drop fuel nozzles are important in the control of combustion dynamics in gas turbine engines and the like. Pressure fluctuations in a fuel nozzle may cause fuel flow rate fluctuations. Fuel flow rate fluctuations may interact with the flame of a combustor to produce pressure oscillations. The resulting fluctuation cycles may be either constructive or destructive, and may lead to oscillations with relatively large amplitude depending upon the magnitude and phase of the interactions. Thus, the acoustic characteristics of the fuel nozzle are critical in the control of gas turbine engine combustion dynamics.

A fuel line is characterized by an acoustic impedance (Z) to the propagation of an acoustic wave through it. This acoustic impedance may be expressed by the following equation:

$$Z=\rho\, C_o/A, \tag{1}$$

where $\rho$ is the density, $C_o$ is the local speed of sound, and A is the cross-sectional area of the orifice used. The amount of acoustic energy reflected and transmitted are expressed by the power reflection coefficient, $\alpha_R=B^2/A^2$, and the power transmission coefficient, $\alpha_T=1-\alpha_R$, where, in a given system, A is the amplitude of a downstream propagating wave and B is the amplitude of an upstream propagating wave. The orifice acoustic resistance is given by the incremental rate of change in the pressure drop with respect to the flow rate. An acoustic impedance matching condition arises when the acoustic impedance of the flow system is substantially equal to the orifice acoustic resistance. Given this condition, the acoustic impedance at the interface approaches untiy, maximizing the transfer of acoustic energy from the fuel nozzle to the combustor. For a fuel nozzle with internal acoustics that may be modified and/or controlled, or for active control schemes using an actuated valve, the resulting fuel pressure wave may be transmitted into the combustor with minimal attenuation. This is a critical step, enabling the internal acoustics of a fuel nozzle to interact acoustically with a combustor.

Conventional attempts at transmitting such a fuel pressure wave into the combustor without reflection have focused on using lumped-parameter soft nozzles or the like with orifices communicating to an internal fuel nozzle volume. Such an assembly is illustrated in FIG. 1. Referring to FIG. 1, it may be seen that a conventional two-stage fuel nozzle 10 includes an upstream orifice 12 and a downstream orifice 14. A captured response volume 16 is disposed there between. The upstream orifice 12 provides a relatively high pressure drop for the gaseous fuel to approximately the pressure of the compressor discharge air. The downstream orifice 14 provides a pressure drop comparable to the pressure drop across the openings of the combustor liner for the air supply.

The dynamic pressure response characteristics of the fuel and air inlets to the premixer zone are substantially matched to eliminate variations in fuel/air concentration resulting from pressure variations in the premixer zone. The captured response volume 16 is sized sufficiently to store enough fuel to accommodate the mismatch in phase angle of fuel flowing into the captured response volume 16 through the upstream orifice 12 at a first phase angle relative to the phase angle of a pressure-forcing function in the premixer zone and fuel flowing out of the captured response volume 16 through the downstream orifice 16 at a second phase angle relative to the phase angle of the pressure-forcing function in the premixer zone. Although acoustic impedance matching is known to those of ordinary skill in the art in transmission line theory, what is still needed are systems and methods that apply it in the context of combustion dynamics.

BRIEF SUMMARY OF THE INVENTION

In various embodiments of the present invention, a fuel nozzle device suitable for use in a gas turbine engine or the like is provided. The fuel nozzle device includes a fuel line and a plurality of gas orifices disposed at a downstream end of the fuel line, the plurality of gas orifices operable for injecting fuel into an air stream. The acoustic resistance of each of the plurality of gas orifices is chosen to match the acoustic impedance of the fuel line such that the maximum acoustic energy may be transferred between the fuel nozzle device and the combustor, thus enhancing the ability of the fuel nozzle device to control the combustion dynamics of the gas turbine engine system. The methods of the present invention may be applied to any combustion system incorporating a fuel injection system coupled to a combustion chamber or the like.

In various embodiments of the present invention, a fuel injection resonator assembly suitable for use in a gas turbine engine or the like is also provided. The fuel injection resonator assembly includes a plurality of orifices separated by a variable length tube. The area ratio of the plurality of orifices may be adjusted using, for example, an automated valve system to modify and/or control the relative flow resistance of the plurality of orifices. The resulting fuel injection resonator assembly acts as a tunable acoustic waveguide operable for delivering fuel to the combustor. The response of this tunable acoustic waveguide to external pressure perturbations may be modified and/or controlled.

In one embodiment of the present invention, a fuel nozzle device operable for injecting a fuel into an air stream and suitable for use in a gas turbine engine system or the like includes an orifice portion having a first cross-sectional area, $A_h$, and a first acoustic impedance, Z1, and a tube portion having a second cross-sectional area, $A_T$, and a second acoustic impedance, Z2. The ratio of the first cross-sectional area, $A_h$, of the orifice portion and the second cross-sectional area, $A_T$, of the tube portion is selected such that the first acoustic impedance, Z1, of the orifice portion is substantially the same as the second acoustic impedance, Z2, of the tube portion. When this occurs, the acoustic impedance at the orifice approaches unity and the power transmitted through the orifice is maximized ($\alpha_T \rightarrow 1$).

In another embodiment of the present invention, a method for controlling the combustion dynamics of a gas turbine engine system or the like includes providing an orifice portion having a first cross-sectional area, $A_h$, and a first acoustic impedance, Z1, and providing a tube portion having a second cross-sectional area, $A_T$, and a second acoustic impedance, Z2. The method also includes selecting the ratio of the first cross-sectional area, $A_h$, of the orifice portion and the second cross-sectional area, $A_T$, of the tube portion such that the first acoustic impedance, Z1, of the orifice portion is substantially the same as the second acoustic impedance, Z2, of the tube portion. Again, when this occurs, the acoustic impedance at the orifice approaches unity and the power transmitted through the orifice is maximized ($\alpha_T \rightarrow 1$).

In a further embodiment of the present invention, a fuel injection resonator assembly operable for injecting a fuel into an air stream and suitable for use in a gas turbine engine system or the like includes a tube portion operable for containing and transporting the fuel, wherein the tube portion comprises an upstream end and a downstream end, and wherein the length of the tube portion is adjustable. The fuel injection resonator assembly also includes a plurality of upstream orifices operable for delivering the fuel to the air stream, wherein the plurality of upstream orifices are disposed about the upstream end of the tube portion. The fuel injection resonator assembly further includes a plurality of downstream orifices operable for delivering the fuel to the air stream, wherein the plurality of downstream orifices are disposed about the downstream end of the tube portion. The length of the tube portion is selected to avoid or achieve assembly resonance in a predetermined range.

In a still further embodiment of the present invention, a fuel injection resonator assembly operable for injecting a fuel into an air stream and suitable for use in a gas turbine engine system or the like includes a tube portion operable for containing and transporting the fuel, wherein the tube portion comprises an upstream end and a downstream end, and wherein the length of the tube portion is adjustable. The fuel injection resonator assembly also includes a plurality of upstream orifices operable for delivering the fuel to the air stream, wherein the plurality of upstream orifices are disposed about the upstream end of the tube portion, and wherein the cross-sectional area of each of the plurality of upstream orifices is adjustable. The fuel injection resonator assembly further includes a plurality of downstream orifices operable for delivering the fuel to the air stream, wherein the plurality of downstream orifices are disposed about the downstream end of the tube portion. The length of the tube portion is selected to avoid or achieve assembly resonance in a predetermined range. The cross-sectional area of each of the plurality of upstream orifices is also selected to avoid or achieve assembly resonance in a predetermined range.

In a still further embodiment of the present invention, a method for controlling the combustion dynamics of a gas turbine engine system or the like includes providing a tube portion operable for containing and transporting a fuel, wherein the tube portion comprises an upstream end and a downstream end, and wherein the length of the tube portion is adjustable. The method also includes providing a plurality of upstream orifices operable for delivering the fuel to an air stream, wherein the plurality of upstream orifices are disposed about the upstream end of the tube portion, and wherein the cross-sectional area of each of the plurality of upstream orifices is adjustable. The method further includes providing a plurality of downstream orifices operable for delivering the fuel to the air stream, wherein the plurality of downstream orifices are disposed about the downstream end of the tube portion. The method still further includes selecting the length of the tube portion to avoid or achieve resonance of the tube portion, the plurality of upstream orifices, and the plurality of downstream orifices in a predetermined range. The method still further includes selecting the cross-sectional area of each of the plurality of upstream orifices to avoid or achieve resonance of the tube portion, the plurality of upstream orifices, and the plurality of downstream orifices in a predetermined range.

BRIEF DESCRIPTION OF THE DRAWINGS

FIG. 1 is a partial cross-sectional side view of one embodiment of a conventional two-stage fuel nozzle that includes an upstream orifice, a downstream orifice, and a captured response volume disposed there between;

DETAILED DESCRIPTION OF THE INVENTION

Figure 1:
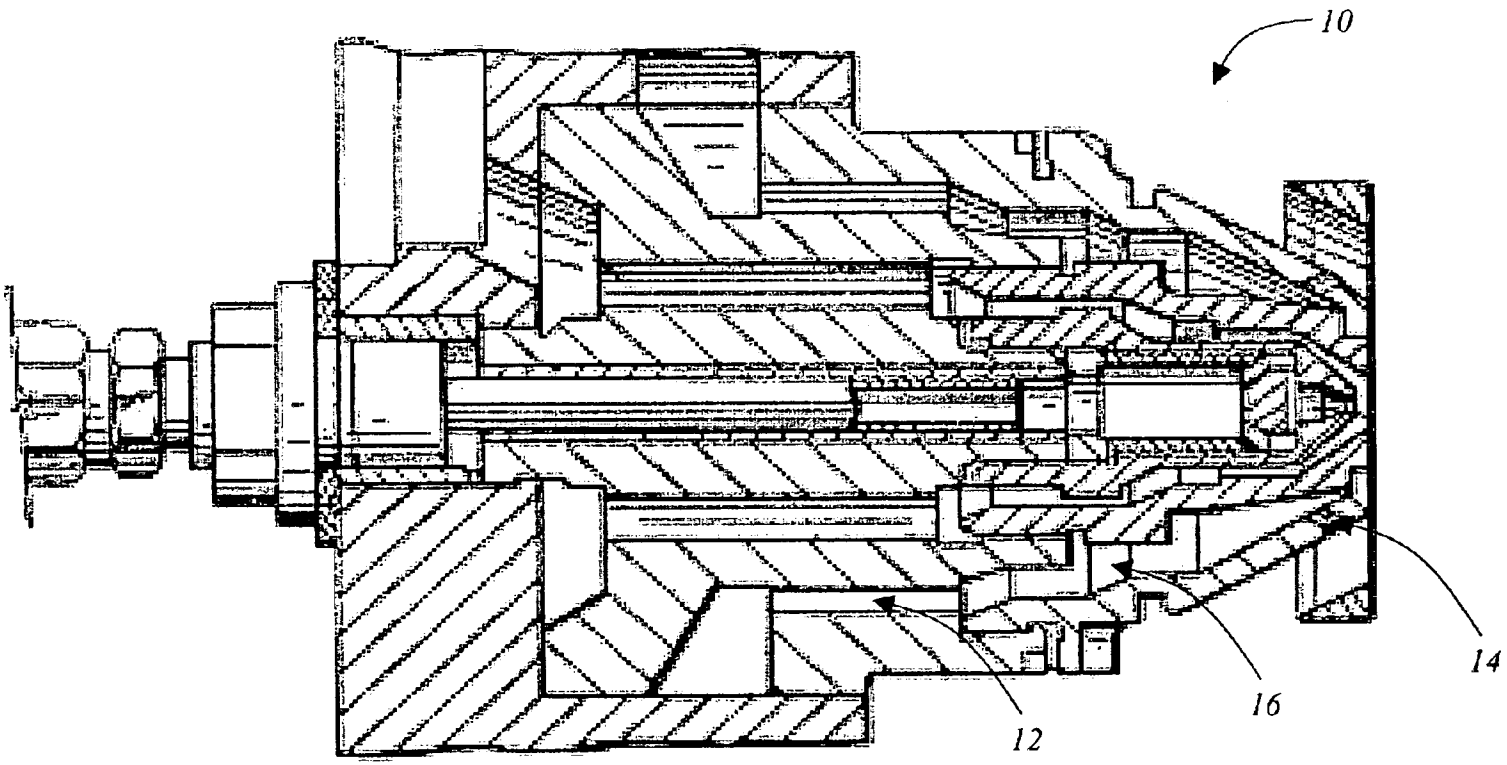
Figure 2:
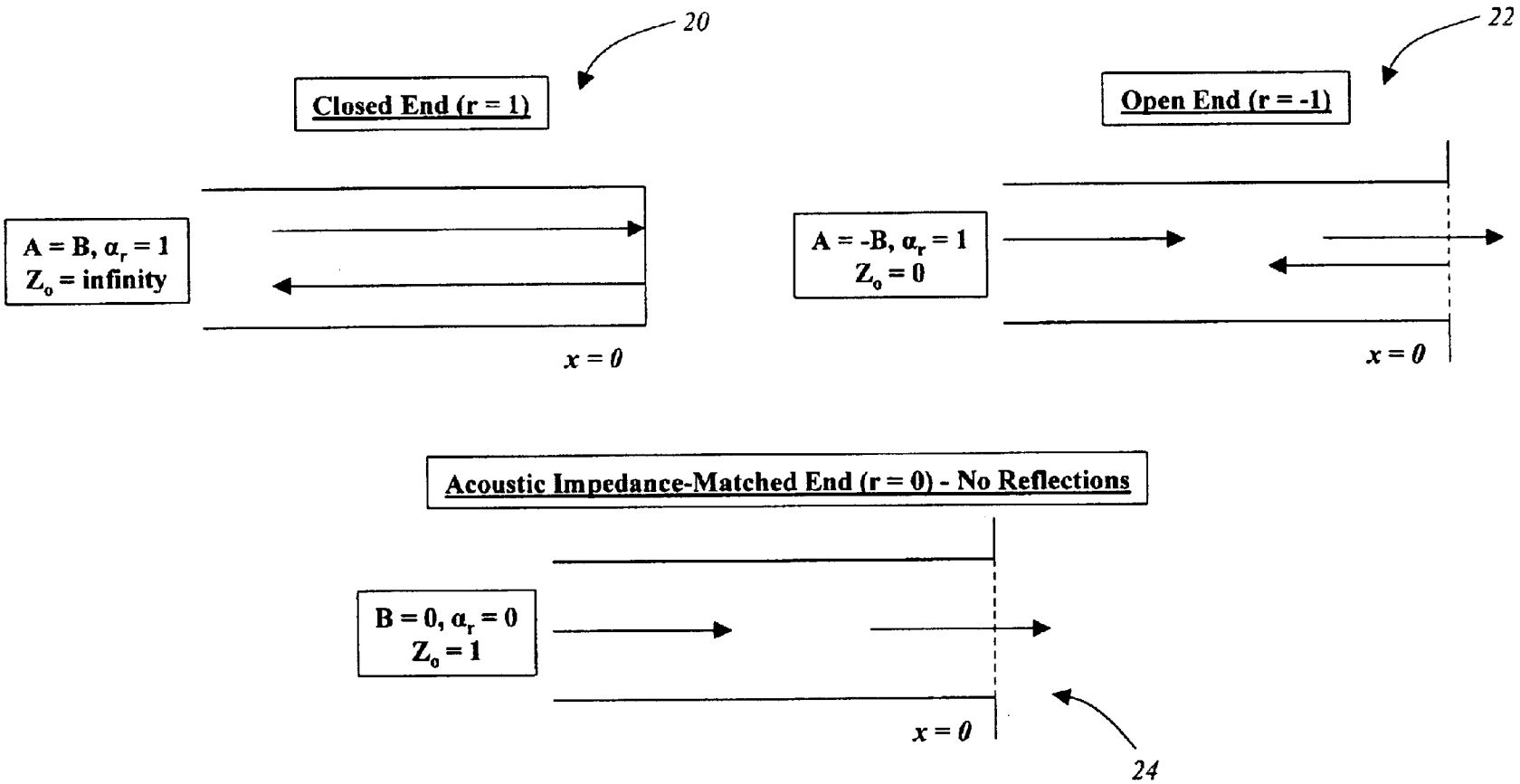
FIG. 2 is a schematic diagram illustrating the relationship between acoustic impedance and the propagation of acoustic reflections for a simple one-dimensional tube with a downstream propagating acoustic wave and an upstream propagating acoustic wave.

FIG. 2 illustrates the relationship between acoustic impedance (Z) and the propagation of acoustic waves for a simple one-dimensional tube, such as a fuel nozzle or the like, with a downstream propagating acoustic wave (A) and an upstream propagating acoustic wave (B). Z may be defined by the following equation:

$$Z=P/Q, \tag{2}$$

where P is the pressure in, for example, $N/m^2$ and Q is the volumetric velocity or volumetric flow rate in, for example, $m^3$/sec. Z may also be defined by the following equation:

$$Z=(A+B)/(A-B), \tag{3}$$

where A is the amplitude of the incident acoustic wave, B is the amplitude of the reflected acoustic wave, the acoustic reflection coefficient (r) is defined as B/A, and the power reflection coefficient ($\alpha_r$) is defined as $B^2/A^2$.

Referring to FIG. 2, if the one-dimensional tube is closed at the end (where x=0) (case 20), the volumetric velocity or volumetric flow rate (U) necessarily goes to zero at the tube/orifice boundary (x=0). Thus, Z tends toward infinity. In this case, A−B=0, A=B, r=1, the power reflection coefficient is 1, and the power transmission coefficient is 0. The incident acoustic wave (A) is reflected back into the one-dimensional tube. If the one-dimensional tube is open at the end (where x=0) (case 22), the pressure (P) at the tube/ orifice boundary (x=0) tends toward zero. Thus, Z tends toward zero. In this case, A+B=0, A=−B, r=−1, the power reflection coefficient is 1, and the power transmission coefficient is 0. The acoustic wave will propagate through the end of the tube and an acoustic reflection wave will propagate back upstream from the tube/orifice boundary (x=0). In the acoustic impedance-matching case (case 24), Z=1. This implies that B=0 (i.e., that there is no acoustic reflection at the tube/orifice boundary (x=0)). In this case, the power reflection coefficient is 0 and the power transmission coefficient is 1. Thus, the incident acoustic wave (A) propagates through the opening at the end of the one-dimensional tube (where x=0) without any reflection and there is no attenuation of the acoustic wave.

Figure 3:
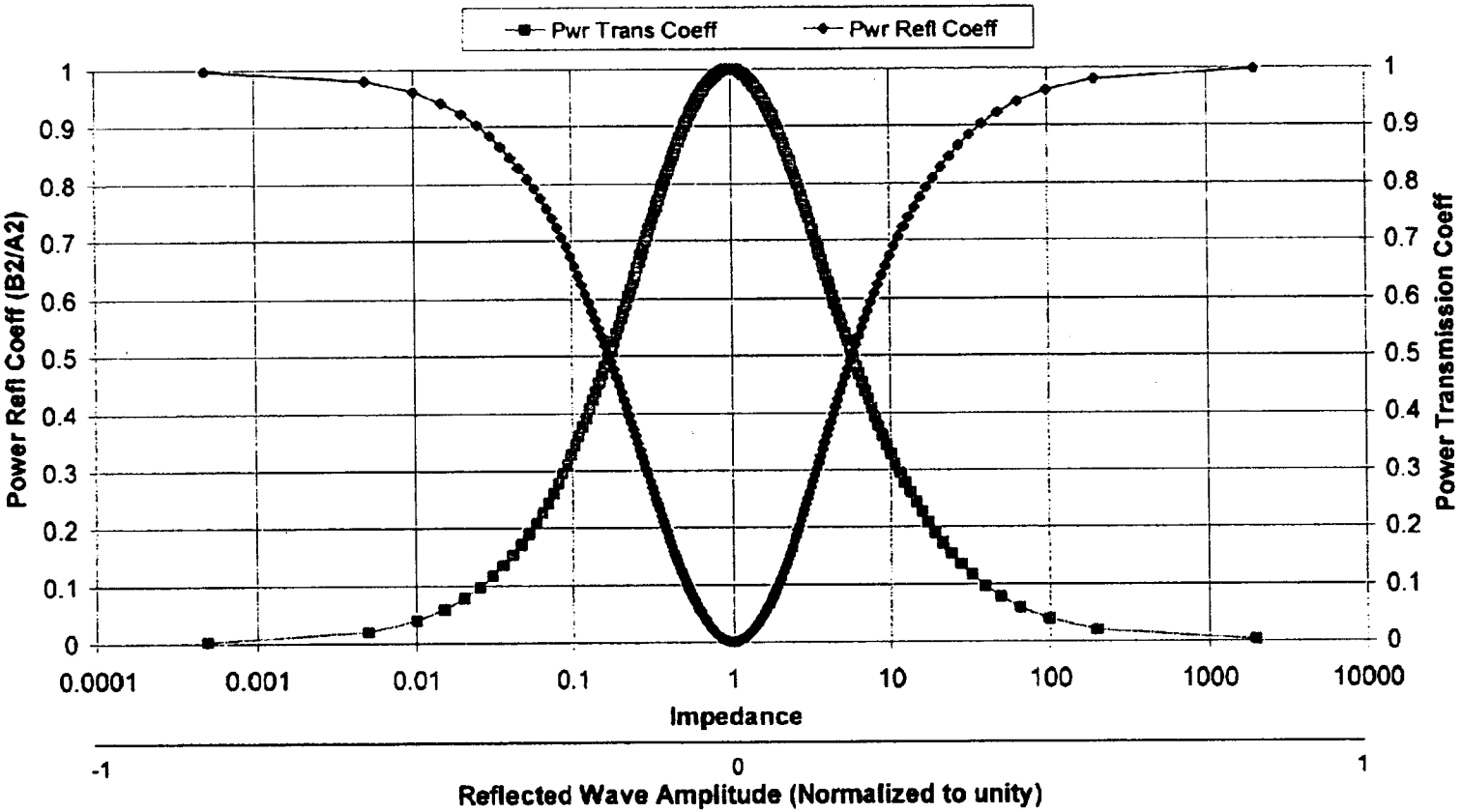
FIG. 3 is a graph illustrating the relationship between acoustic impedance, a power reflection coefficient, and a power transmission coefficient.
Figure 4:
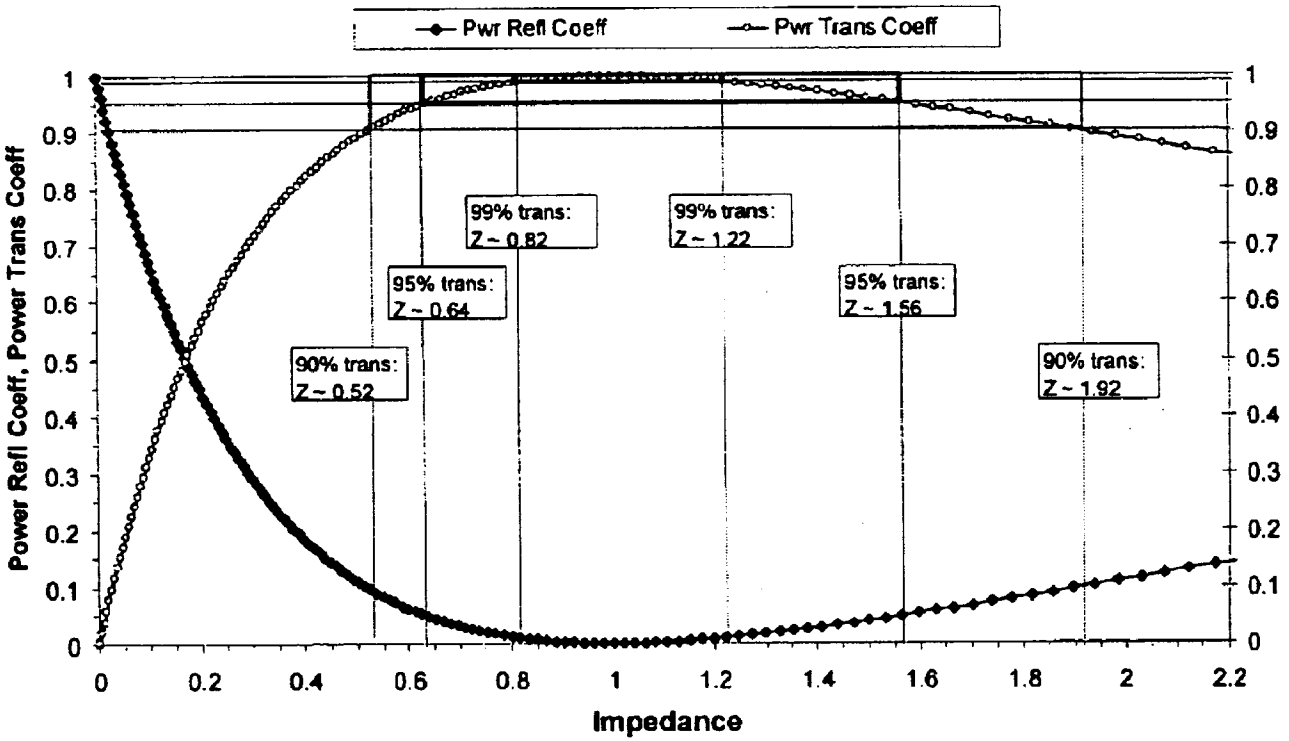
FIG. 4 is another graph illustrating the relationship between acoustic impedance, the power reflection coefficient, and the power transmission coefficient.

The relationship between acoustic impedance (Z) and the power coefficients is illustrated in FIGS. 3 and 4. As Z decreases from unity (maximum transmission), the power reflection coefficient increases and the power transmission coefficient decreases. The same occurs as Z increases from unity. To obtain a power transmission coefficient greater than about 90%, the acoustic impedance must be greater than about 0.52, but less than about 1.92.

The following equations may be used for the flow through an orifice and a tube:

$$\dot{m}_O = A_h C_D \sqrt{2\rho\Delta p}, \tag{4}$$

where $A_h$ is the cross-sectional area of the orifice, $C_D$ is the discharge coefficient of the orifice, and Δp is the pressure drop across the orifice, and $$\dot{m}_T = A_T \rho\, U_T, \tag{5}$$

where $A_T$ is the cross-sectional area of the tube and $U_T$ is the flow velocity (m/s) through the tube.

Using conservation of mass principles to set the flow through the tube equal to the flow through the orifice the following equation is obtained:

$$A_h C_D \sqrt{2\rho\Delta p} = A_T \rho U_T. \tag{6}$$

Solving for the velocity in the tube yields the following equation:

$$U_T = \frac{A_h C_D}{A_T \rho}\sqrt{2\rho\Delta p}. \tag{7}$$

As described above, the acoustic impedance (Z) may be defined as the ratio of pressure to volumetric flow rate, or as the density times the local speed of sound divided by the cross-sectional area of the given flow passage, according to the following equation:

$$Z = P/Q = P/AU = \rho C_o/A. \tag{8}$$

Using this equation, the ratio P/U may be defined as $\rho C_o$. Examining perturbations in these quantities and inverting this ratio yields the following equation:

$$\frac{\Delta U}{\Delta p} = \frac{1}{\rho C_o}. \tag{9}$$

Using the expression for the volume velocity in the tube and taking the derivative yields the following expression for dU/dΔp:

$$\frac{dU_T}{d(P)} = \frac{AhC_D}{A_T\rho}\frac{1}{2}\frac{1}{\sqrt{2\rho\Delta p}}2\rho, \tag{10}$$

and canceling the terms 2ρ yields the following expression:

$$\frac{dU_T}{d(P)} = \frac{AhC_D}{A_T}\frac{1}{\sqrt{2\rho\Delta p}}. \tag{11}$$

Equating the acoustic impedance in the tube and the acoustic impedance in the orifice is accomplished by equating equations (9) and (11) as follows:

$$\frac{1}{\rho C_o} = \frac{AhC_D}{A_T}\frac{1}{\sqrt{2\rho\Delta p}}. \tag{12}$$

Solving for the area ratio yields the following expression:

$$\frac{A_h}{A_T} = \frac{\sqrt{2\rho\Delta P}}{\rho C_D C_o}. \tag{13}$$

Defining the following terms:

$$\Delta p = dp\ \%\times P$$
$$C_o = \gamma P/\rho,$$
$$P/\rho = C_o^2/\gamma \tag{14}$$

where γ is the ratio of the specific heats ($C_p/C_v$) and is characteristic of the given fluid. Substituting the expression for Δp into equation (13), and using the relationship between P and ρ yields the following expression:

$$\frac{A_h}{A_T} = \sqrt{\frac{2\,dp\%}{C_D^2\gamma}}. \tag{15}$$

Thus, given the area of a tube ($A_T$), the desired pressure drop (dp %), and the discharge coefficient of the associated orifice ($C_D$), the area of the orifice ($A_h$) required to attain an acoustic impedance-matched condition may be determined. Likewise, the area (and, hence, the diameter) of the tube may also be determined given the area of the orifice. It should be noted that it is not necessary to set both the acoustic impedance in the tube and the acoustic impedance in the orifice equal to 1 to obtain the desired benefits from the processes described herein. As described above, for Z=0.52–1.92, the power transmission coefficient is equals about 90%. This relationship is illustrated in FIGS. 3 and 4.

Figure 5:
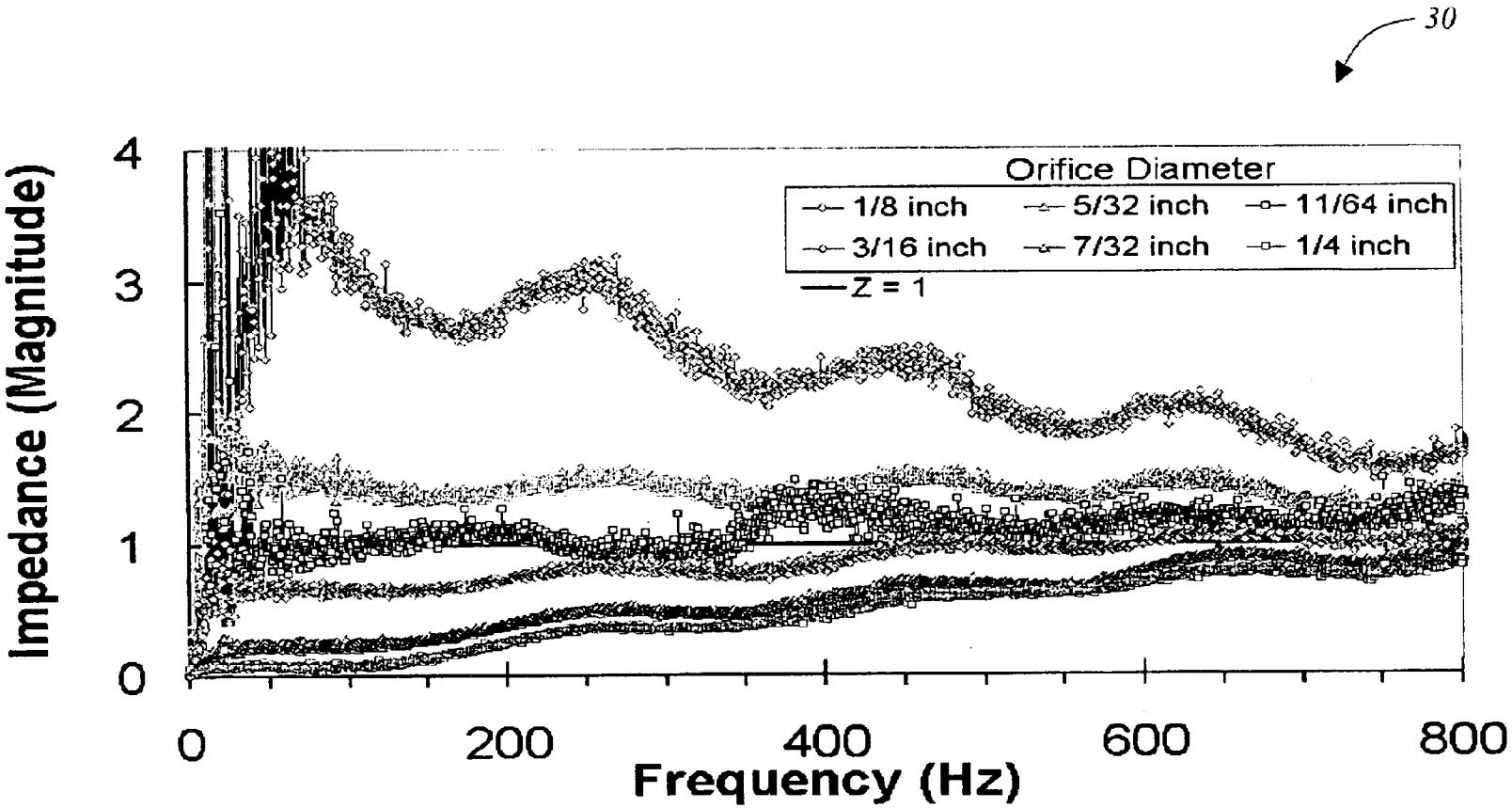
FIG. 5 is a graph illustrating the results of a series of experiments performed using a one-dimensional tube demonstrating that an acoustic impedance-matched condition may be obtained over a relatively large frequency bandwidth using the systems and methods of the present invention.

A series of experiments were performed using a one-dimensional tube to determine whether or not an acoustic impedance-matched condition could be obtained over a relatively large frequency bandwidth. A plurality of orifices with varying diameters (about ⅛ inch, about 5⁄32 inch, about 11⁄64 inch, about 3⁄16 inch, about 7⁄32 inch, and about ¼ inch) were used in conjunction with the one-dimensional tube. The experiments indicated that the ⅛ inch orifice provided an end boundary condition similar to that of an open tube (Z→0). The experiments also indicated that the ¼ inch orifice provided an end boundary condition similar to that of a closed tube (Z→infinity). The results are illustrated in the graph 30 of FIG. 5. For the given geometry and pressure drop, an orifice diameter of about 11⁄64 inches provided an acoustic impedance-matched condition over a relatively large frequency bandwidth.

Figure 6:
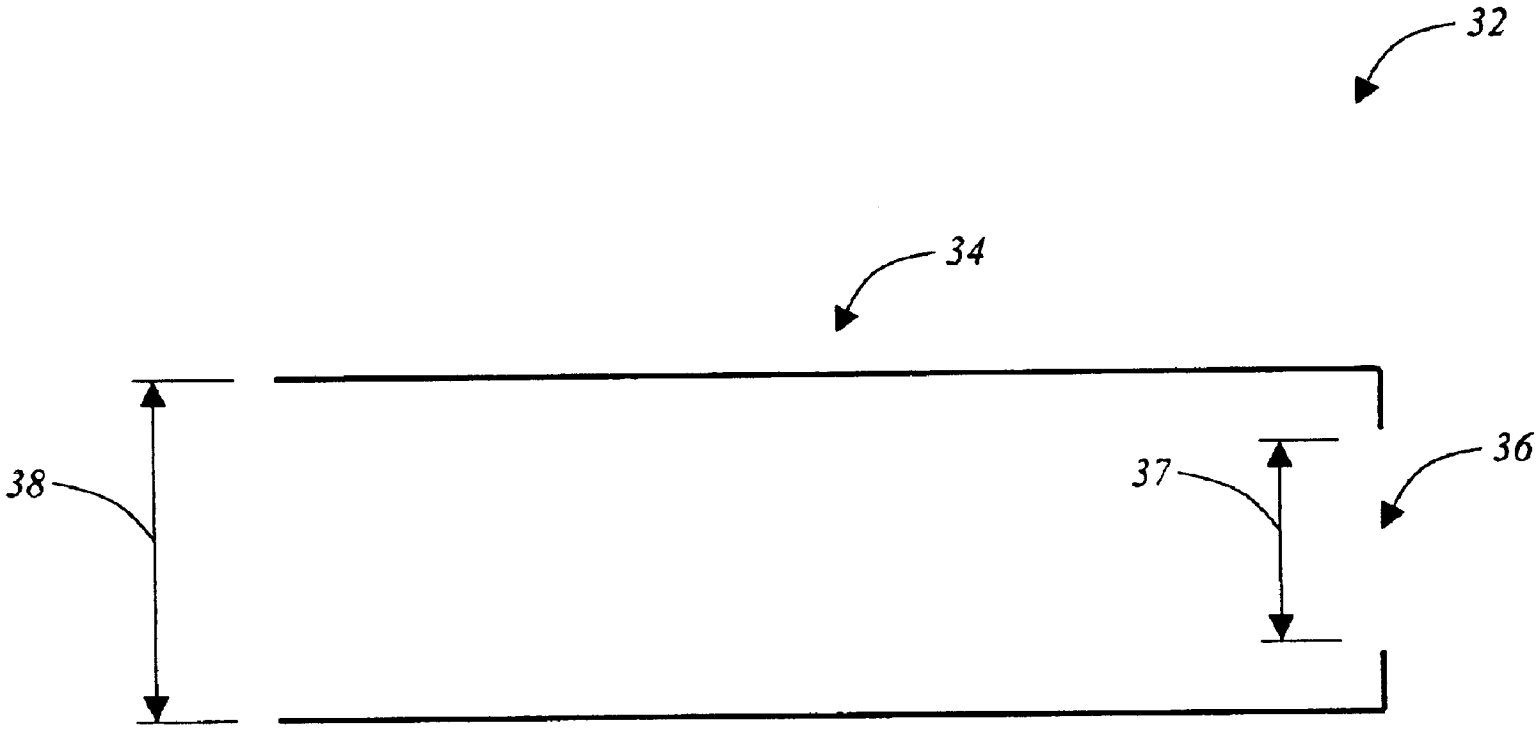
FIG. 6 is a schematic diagram illustrating one embodiment of the acoustic impedance-matched fuel nozzle device of the present invention.
Figure 7:
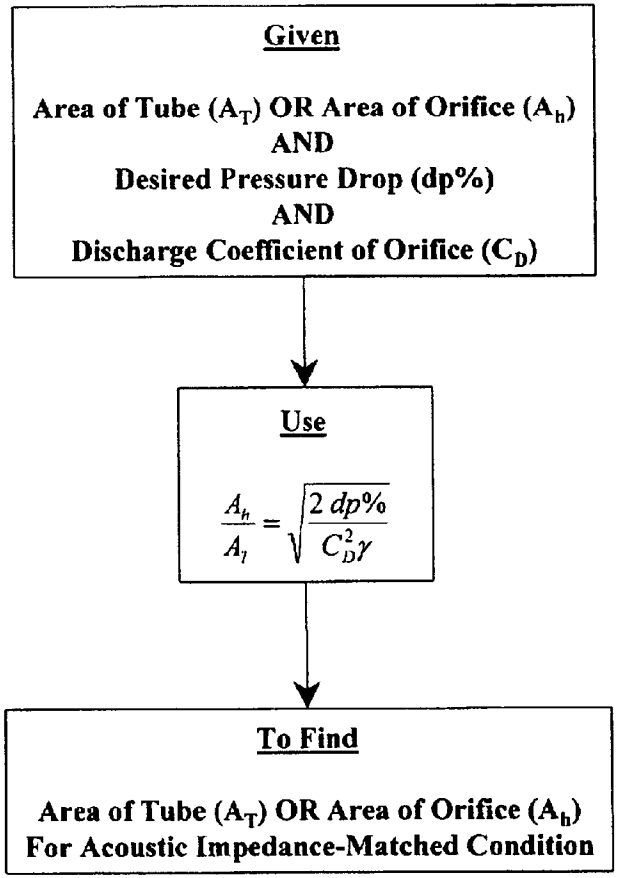
FIG. 7 is a flow chart illustrating one embodiment of the acoustic impedance-matching method of the present invention.

Referring to FIGS. 6 and 7, an acoustic-impedance-matched fuel nozzle device 32 incorporating the principles described above includes a tube portion 34 and an orifice portion 36. Collectively, the tube portion 34 and the orifice portion 36 of the acoustic impedance-matched fuel nozzle device 32 are operable delivering fuel to and introducing fuel into an air stream, such as that present in the combustor of a gas turbine engine or the like. Preferably, the ratio of the area 37 of the orifice portion 36 of the acoustic impedance-matched fuel nozzle device 32 to the area 38 of the tube portion 34 of the acoustic impedance-matched fuel nozzle device follows equation (15) and, as described above, the acoustic impedance-matched fuel nozzle device 32 matches the acoustic impedance of the tube portion 34 with the acoustic impedance of the orifice portion 36 to achieve enhanced performance. Other characteristics of the acoustic impedance-matched fuel nozzle device 32 may be controlled as well, providing a fully tunable fuel injection resonator assembly that enables fuel system acoustic response to be adjusted in such a way as to minimize the interaction of the fuel system with the combustion system to which it is connected. Advantageously, this results in reduced combustion-driven oscillations caused by fuel system-combustion system coupling.

Figure 8:
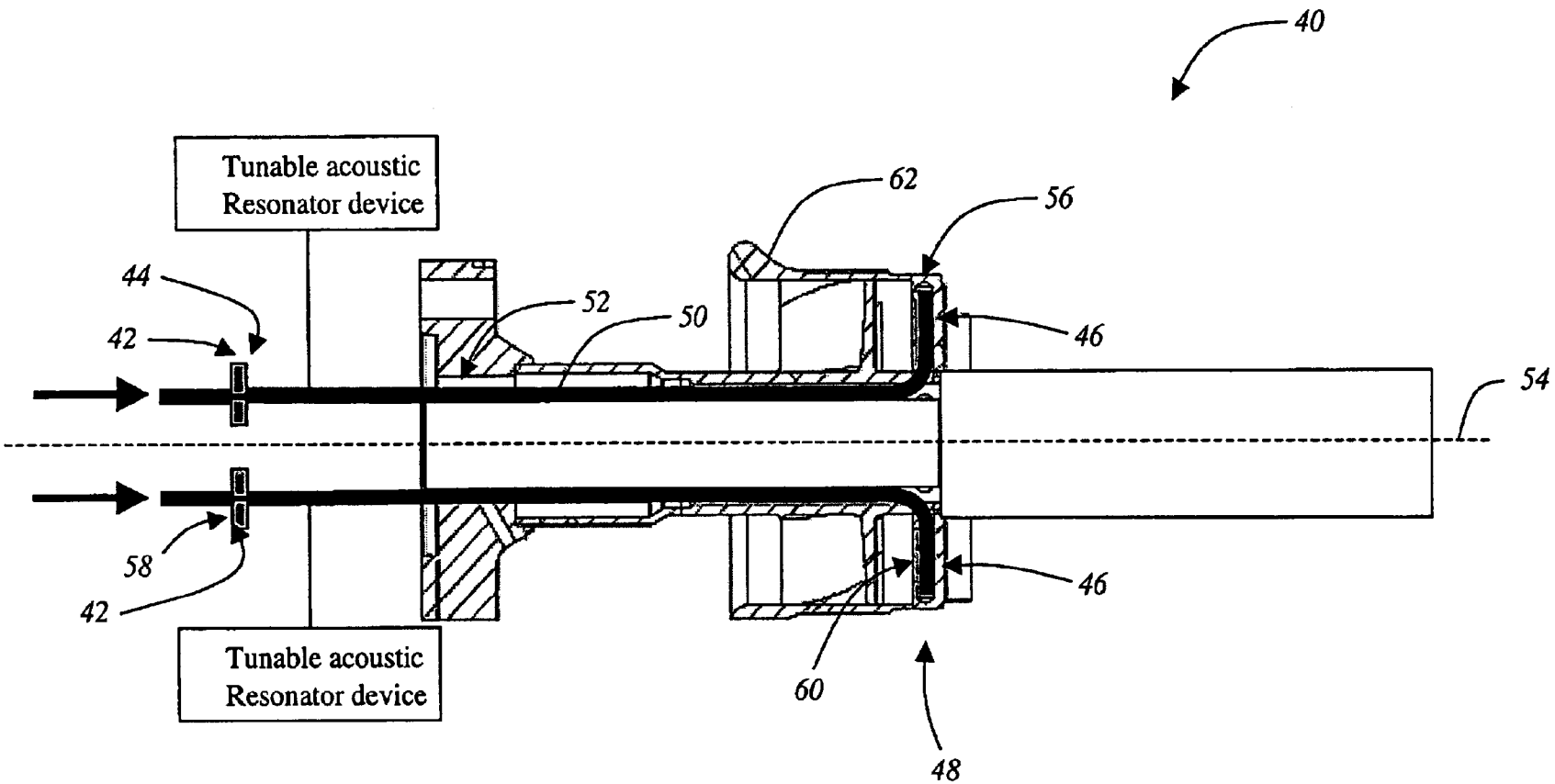
FIG. 8 is a partial cross-sectional side view of one embodiment of the tunable fuel injection resonator of the present invention.
Figure 9:
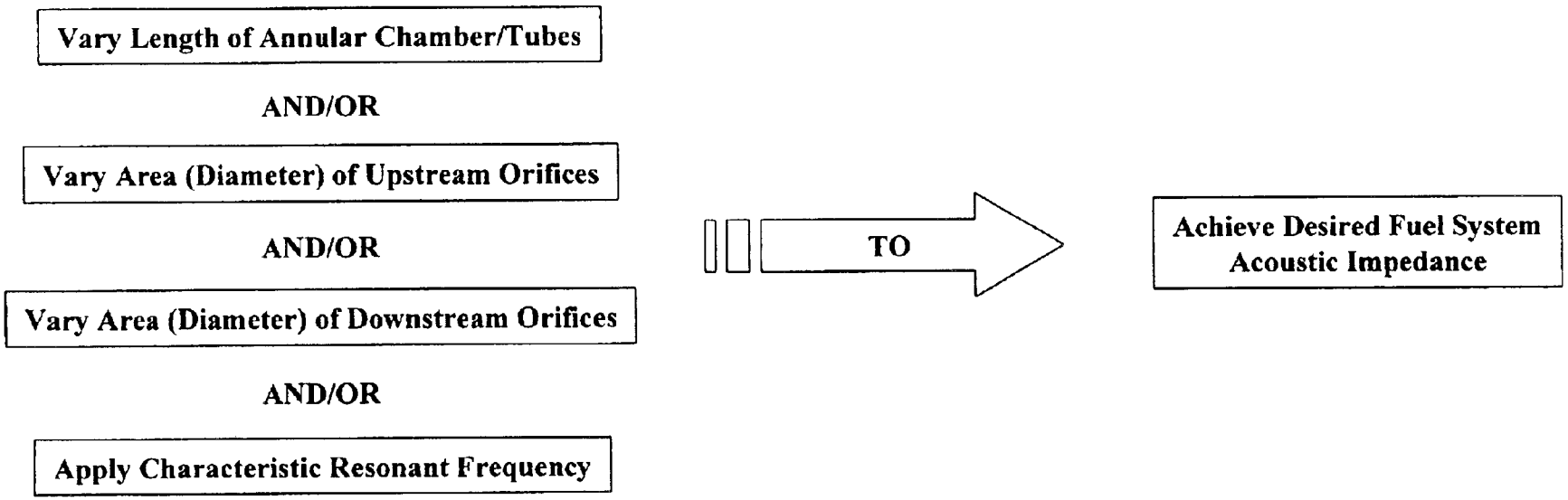
FIG. 9 is a flow chart illustrating one embodiment of the acoustic tuning method of the present invention.

Referring to FIGS. 8 and 9, the tunable fuel injection resonator assembly 40 of the present invention includes a plurality of upstream orifices 42 disposed at an upstream end 44 of the tunable fuel injection resonator assembly 40 and a plurality of downstream orifices 46 disposed at a downstream end 48 of the tunable fuel injection resonator assembly 40. The plurality of upstream orifices 42 are connected to the plurality of downstream orifices 46 by an annular chamber 50 or the like having a variable length. The annular chamber 50 forms an acoustic passage. Preferably, the annular chamber 50 includes a first portion 52 extending along an axis 54 of the tunable fuel injection resonator assembly 40 and a second portion 56 extending radially outward from the axis 54 of the tunable fuel injection resonator assembly 40. The plurality of upstream orifices 42 are disposed within/around the first portion 52 of the annular chamber 50 of the tunable fuel injection resonator assembly 40 and the plurality of downstream orifices 46 are disposed within/around the second portion 56 of the annular chamber 50 of the tunable fuel injection resonator assembly 40. Optionally, the plurality of upstream orifices 42 and the plurality of downstream orifices 46 are disposed within/around a first flange 58 and a second flange 60 attached to or integrally formed with the first portion 52 of the annular chamber 50 of the tunable fuel injection resonator assembly 40 and the second portion 56 of the annular chamber 50 of the tunable fuel injection resonator assembly 40, respectively. Further, the second portion 56 of the annular chamber 50 may include a plurality of peg structures (not shown) housing the plurality of downstream orifices 46.

It should be noted that FIG. 8 illustrates an embodiment of the tunable fuel injection resonator assembly 40 of the present invention as applied to a DLN2 fuel nozzle for a 7FA+e center nozzle. This setup may feature, for example, a plurality of adjustable upstream orifices 42, a plurality of fixed-area downstream orifices 46, and an adjustable-length annular chamber 50.

In an alternative embodiment of the present invention, the plurality of upstream orifices 42 are connected to the plurality of downstream orifices 46 by a plurality of tubes or the like (not shown), each of the plurality of tubes having a variable length. Each of the plurality of tubes forms an acoustic passage. Preferably, each of the plurality of tubes includes a first portion extending along the axis 54 of the tunable fuel injection resonator assembly 40 and a second portion extending radially outward from the axis 54 of the tunable fuel injection resonator assembly 40. The plurality of upstream orifices 42 are disposed within/around the first portion of each of the plurality of tubes of the tunable fuel injection resonator assembly 40 and the plurality of downstream orifices 46 are disposed within/around the second portion of each of the plurality of tubes of the tunable fuel injection resonator assembly 40. Optionally, the plurality of upstream orifices 42 and the plurality of downstream orifices 46 are disposed within/around a first flange (not shown) and a second flange (not shown) attached to or integrally formed with the first portion of each of the plurality of tubes of the tunable fuel injection resonator assembly 40 and the second portion of each of the plurality of tubes of the tunable fuel injection resonator assembly 40, respectively.

The annular chamber 50 or the plurality of tubes are operable for carrying fuel from a fuel source (not shown) to the plurality of upstream orifices 42 and/or the plurality of downstream orifices 46, where the fuel is expelled into an air flow of the combustor (not shown). Advantageously, the area of each of the plurality of upstream orifices 42 (and/or their combined area) and/or each of the plurality of downstream orifices 46 (and/or their combined area) may be varied, providing a tunable acoustic waveguide for delivering fuel to the combustor. Optionally, the tunable fuel injection resonator assembly 40 includes a premixer assembly 62 operable for securing the tunable fuel injection resonator assembly 40 to the combustor. The area of each of the plurality of upstream orifices 42 (and/or their combined area) and/or each of the plurality of downstream orifices 46 (and/or their combined area) may be varied during the manufacturing process or via the use of an automated valve system or the like. Likewise, the length of the annular chamber 50 or the plurality of tubes may be varied during the manufacturing process or via the use of an automated actuation system or the like, also providing a tunable acoustic waveguide for delivering fuel to the combustor.

Thus, the adjustable nature of the plurality of upstream orifices 42, the plurality of downstream orifices 46, and/or the annular chamber 50 or the plurality of tube allow the fuel system to be acoustically tuned so as not to possess a resonance in a critical range that results in strong fuel system-combustion system coupling when implemented in a gas turbine engine or the like. In other words, the tunable fuel injection resonator assembly 40 of the present invention may be adjusted to vary the fuel system acoustic impedance, or acoustic response, while maintaining a constant pressure drop in the fuel line, providing the ability to maintain a steady fuel mass. Optionally, the operation of the tunable fuel injection resonator assembly 40 may be controlled using an automated logic system (not shown), providing the real-time suppression of combustion oscillations in a fielded system. This control system may be responsive to varied engine operating conditions and fuel system pressures and allows for acoustic impedance matching if for example, the fuel supply is to be pulsed (sinusoidally, etc.).

In another alternative embodiment of the present invention, a tunable acoustic resonator device, such as a Helmholz resonator, is coupled with the tunable fuel injection resonator assembly 40 to vary the system acoustic impedance, or acoustic response, while maintaining a constant pressure drop in the fuel line, also providing the ability to maintain a steady fuel mass.

It is apparent that there have been provided, in accordance with the systems and methods of the present invention, an acoustic impedance-matched fuel nozzle device and a tunable fuel injection resonator assembly. Although the systems and methods of the present invention have been described with reference to preferred embodiments and examples thereof, other embodiments and examples may perform similar functions and/or achieve similar results. For example, although the systems and methods of the present invention have been described in relation to a gas turbine engine or the like, the acoustic impedance-matched fuel nozzle device and the tunable fuel injection resonator assembly may be used in conjunction with any system, assembly, apparatus, device, or method that incorporates a fuel injection system coupled with a combustion chamber. All such equivalent embodiments and examples are within the spirit and scope of the present invention and are intended to be covered by the following claims.

What is claimed is:

1. A fuel nozzle device operable for injecting a fuel into an air stream and suitable for use in a gas turbine engine system or the like, the fuel nozzle device comprising:

an orifice portion having a first cross-sectional area, $A_h$, and a first acoustic impedance, Z1;

a tube portion having a second cross-sectional area, $A_T$, and a second acoustic impedance, Z2; and wherein the ratio of the first cross-sectional area, $A_h$, of the orifice portion and the second cross-sectional area, $A_T$, of the tube portion is selected such that the first acoustic impedance, Z1, of the orifice portion is substantially the same as the second acoustic impedance, Z2, of the tube portion.

2. The fuel nozzle device of claim 1, wherein the orifice portion comprises a plurality of orifices each having a first cross-sectional area, $A_h$, and a first acoustic impedance, Z1.

3. The fuel nozzle device of claim 2, wherein the ratio of the first cross-sectional area, $A_h$, of each of the plurality of orifices and the second cross-sectional area, $A_T$, of the tube portion is selected such that the first acoustic impedance, Z1, of each of the plurality of orifices is substantially the same as the second acoustic impedance, Z2, of the tube portion.

4. The fuel nozzle device of claim 1, wherein the ratio of the first cross-sectional area, $A_h$, of the orifice portion and the second cross-sectional area, $A_T$, of the tube portion is expressed by the equation:

$$\frac{A_h}{A_T} = \sqrt{\frac{2\,dp\%}{C_D^2\gamma}},$$

wherein dp % comprises a predetermined pressure drop, $C_D$ comprises a discharge coefficient of the orifice portion, and $\gamma$ comprises a predetermined characteristic of the fuel.

5. The fuel nozzle device of claim 1, wherein the tube portion comprises a fuel line.

6. The fuel nozzle device of claim 1, wherein the first cross-sectional area, $A_h$, of the orifice portion is adjustable.

7. The fuel nozzle device of claim 1, wherein the second cross-sectional area, $A_T$, of the tube portion is adjustable.

8. The fuel nozzle device of claim 1, wherein the air stream is disposed within a combustion device.

9. The fuel nozzle device of claim 1, wherein Z1 and Z2 comprise values between 0.52 and 1.92.

10. A method for controlling the combustion dynamics of a gas turbine engine system or the like, the method comprising:

providing an orifice portion having a first cross-sectional area, $A_h$, and a first acoustic impedance, Z1;

providing a tube portion having a second cross-sectional area, $A_T$, and a second acoustic impedance, Z2; and selecting the ratio of the first cross-sectional area, $A_h$, of the orifice portion and the second cross-sectional area, $A_T$, of the tube portion such that the first acoustic impedance, Z1, of the orifice portion is substantially the same as the second acoustic impedance, Z2, of the tube portion.

11. The method of claim 10, wherein the orifice portion comprises a plurality of orifices each having a first cross-sectional area, $A_h$, and a first acoustic impedance, Z1.

12. The method of claim 11, wherein selecting the ratio of the first cross-sectional area, $A_h$, of the orifice portion and the second cross-sectional area, $A_T$, of the tube portion such that the first acoustic impedance, Z1, of the orifice portion is substantially the same as the second acoustic impedance, Z2, of the tube portion comprises selecting the ratio of the first cross-sectional area, $A_h$, of each of the plurality of orifices and the second cross-sectional area, $A_T$, of the tube portion such that the first acoustic impedance, Z1, of each of the plurality of orifices is substantially the same as the second acoustic impedance, Z2, of the tube portion.

13. The method of claim 10, wherein the ratio of the first cross-sectional area, $A_h$, of the orifice portion and the second cross-sectional area, $A_T$, of the tube portion is expressed by the equation:

$$\frac{A_h}{A_T} = \sqrt{\frac{2\,dp\%}{C_D^2\gamma}},$$

wherein dp % comprises a predetermined pressure drop, $C_D$ comprises a discharge coefficient of the orifice portion, and $\gamma$ comprises a predetermined characteristic of a fuel.

14. The method of claim 10, wherein providing the tube portion comprises providing a fuel line.

15. The method of claim 10, further comprising adjusting the first cross-sectional area, $A_h$, of the orifice portion.

16. The method of claim 10, further comprising adjusting the second cross-sectional area, $A_T$, of the tube portion.

17. A fuel injection resonator assembly operable for injecting a fuel into an air stream and suitable for use in a gas turbine engine system or the like, the fuel injection resonator assembly comprising:

a tube portion operable for containing and transporting the fuel, wherein the tube portion comprises an upstream end and a downstream end, and wherein the length of the tube portion is adjustable;

a plurality of upstream orifices operable for delivering the fuel to the air stream, wherein the plurality of upstream orifices are disposed about the upstream end of the tube portion;

a plurality of downstream orifices operable for delivering the fuel to the air stream, wherein the plurality of downstream orifices are disposed about the downstream end of the tube portion; and wherein the length of the tube portion is selected during operation to avoid or achieve assembly resonance in a predetermined range.

18. The fuel injection resonator assembly of claim 17, wherein the tube portion comprises an annular chamber.

19. The fuel injection resonator assembly of claim 17, wherein the tube portion comprises a plurality of tubes.

20. The fuel injection resonator assembly of claim 17, wherein the cross-sectional area of each of the plurality of upstream orifices is adjustable.

21. The fuel injection resonator assembly of claim 20, wherein the cross-sectional area of each of the plurality of upstream orifices is selected to avoid or achieve assembly resonance in a predetermined range.

22. The fuel injection resonator assembly of claim 17, wherein the cross-sectional area of each of the plurality of downstream orifices is adjustable.

23. The fuel injection resonator assembly of claim 22, wherein the cross-sectional area of each of the plurality of downstream orifices is selected to avoid or achieve assembly resonance in a predetermined range.

24. The fuel injection resonator assembly of claim 17, further comprising a tunable acoustic resonator device in communication with the tube portion, wherein the tunable acoustic resonator device is operable for applying a resonant frequency to the tube portion.

25. The fuel injection resonator assembly of claim 24, wherein the resonant frequency of the tunable acoustic resonator device is selected to avoid or achieve assembly resonance in a predetermined range.

26. The method of claim 24, wherein the tunable acoustic resonator device is a Helmholtz resonator.

27. The fuel injection resonator assembly of claim 17, wherein the air stream is disposed within a combustion device.

28. A fuel injection resonator assembly operable for injecting a fuel into an air stream and suitable for use in a gas turbine engine system or the like, the fuel injection resonator assembly comprising:

a tube portion operable for containing and transporting the fuel, wherein the tube portion comprises an upstream end and a downstream end, and wherein the length of the tube portion is adjustable;

a plurality of upstream orifices operable for delivering the fuel to the air stream, wherein the plurality of upstream orifices are disposed about the upstream end of the tube portion, and wherein the cross-sectional area of each of the plurality of upstream orifices is adjustable;

a plurality of downstream orifices operable for delivering the fuel to the air stream, wherein the plurality of downstream orifices are disposed about the downstream end of the tube portion;

wherein the length of the tube portion is selected during operation to avoid or achieve assembly resonance in a predetermined range; and wherein the cross-sectional area of each of the plurality of upstream orifices is selected during operation to avoid or achieve assembly resonance in a predetermined range.

29. The fuel injection resonator assembly of claim 28, wherein the tube portion comprises an annular chamber.

30. The fuel injection resonator assembly of claim 28, wherein the tube portion comprises a plurality of tubes.

31. The fuel injection resonator assembly of claim 28, wherein the cross-sectional area of each of the plurality of downstream orifices is adjustable.

32. The fuel injection resonator assembly of claim 31, wherein the cross-sectional area of each of the plurality of downstream orifices is selected to avoid or achieve assembly resonance in a predetermined range.

33. The fuel injection resonator assembly of claim 28, further comprising a tunable acoustic resonator device in communication with the tube portion, wherein the tunable acoustic resonator device is operable for applying a resonant frequency to the tube portion.

34. The fuel injection resonator assembly of claim 33, wherein the resonant frequency of the tunable acoustic resonator device is selected to avoid or achieve assembly resonance in a predetermined range.

35. The method of claim 33, wherein the tunable acoustic resonator device is a Helmholtz resonator.

36. The fuel injection resonator assembly of claim 28, wherein the air stream is disposed within a combustion device.

37. A method for controlling the combustion dynamics of a gas turbine engine system or the like, the method comprising:

providing a tube portion operable for containing and transporting a fuel, wherein the tube portion comprises an upstream end and a downstream end, and wherein the length of the tube portion is adjustable;

providing a plurality of upstream orifices operable for delivering the fuel to an air stream, wherein the plurality of upstream orifices are disposed about the upstream end of the tube portion, and wherein the cross-sectional area of each of the plurality of upstream orifices is adjustable;

providing a plurality of downstream orifices operable for delivering the fuel to the air stream, wherein the plurality of downstream orifices are disposed about the downstream end of the tube portion;

selecting the length of the tube portion during operation to avoid or achieve resonance of the tube portion, the plurality of upstream orifices, and the plurality of downstream orifices in a predetermined range; and selecting the cross-sectional area of each of the plurality of upstream orifices during operation to avoid or achieve resonance of the tube portion, the plurality of upstream orifices, and the plurality of downstream orifices in a predetermined range.

38. The method of claim 37, wherein providing the tube portion comprises providing an annular chamber.

39. The method of claim 37, wherein providing the tube portion comprises providing a plurality of tubes.

40. The method of claim 37, wherein the cross-sectional area of each of the plurality of downstream orifices is adjustable.

41. The method of claim 40, further comprising selecting the cross-sectional area of each of the plurality of downstream orifices to avoid or achieve resonance of the tube portion, the plurality of upstream orifices, and the plurality of downstream orifices in a predetermined range.

42. The method of claim 37, further comprising providing a tunable acoustic resonator device in communication with the tube portion, wherein the tunable acoustic resonator device is operable for applying a resonant frequency to the tube portion.

43. The method of claim 42, further comprising selecting the resonant frequency of the tunable acoustic resonator device to avoid or achieve resonance of the tube portion, the plurality of upstream orifices, and the plurality of downstream orifices in a predetermined range.

44. The method of claim 42, wherein the tunable acoustic resonator device is a Helmholtz resonator.

* * * * *